US006196031B1

(12) United States Patent
Ducauchuis

(10) Patent No.: US 6,196,031 B1
(45) Date of Patent: Mar. 6, 2001

(54) LOW UNIT WEIGHT KNITTED LOOP FABRIC

(75) Inventor: Jean-Pierre Ducauchuis, Nantes (FR)

(73) Assignee: Aplix, Paris (FR)

( * ) Notice: Subject to any disclaimer, the term of this patent is extended or adjusted under 35 U.S.C. 154(b) by 0 days.

(21) Appl. No.: 09/533,568

(22) Filed: Mar. 22, 2000

(30) Foreign Application Priority Data

Mar. 30, 1999 (FR) ..... 99 03954

(51) Int. Cl.[7] ..... D04B 21/02; A44B 18/00
(52) U.S. Cl. ..... 66/192; 66/195; 24/445
(58) Field of Search ..... 66/190, 191, 192, 66/193, 195, 196; 24/445, 442, 446

(56) References Cited

U.S. PATENT DOCUMENTS

| | | | | |
|---|---|---|---|---|
| 5,214,942 | * | 6/1993 | Peake, III et al. | 66/202 |
| 5,267,453 | * | 12/1993 | Peake, III et al. | 66/202 |
| 5,407,722 | * | 4/1995 | Peake, III et al. | 66/202 |
| 5,449,530 | * | 9/1995 | Peake, III et al. | 66/202 |
| 5,503,892 | * | 4/1996 | Callaway | 66/202 |
| 5,520,022 | * | 5/1996 | Callaway | 66/202 |

FOREIGN PATENT DOCUMENTS

| | | |
|---|---|---|
| 0 517 275 A2 | 12/1992 | (EP) . |
| 0 645 486 A1 | 3/1995 | (EP) . |
| 0 694 642 A1 | 1/1996 | (EP) . |
| 2 317 403 | 2/1977 | (FR) . |
| 2 632 830 | 12/1989 | (FR) . |

* cited by examiner

*Primary Examiner*—Danny Worrell
(74) *Attorney, Agent, or Firm*—Adams, Schwartz & Evans, P.A.

(57) ABSTRACT

A knitted loop fabric comprising: a ground of warp yarns or wales (8,11) of stitches forming a network of wales parallel to one another and of weft connecting yarns or weft yarns (6), the latter being connected to the warp yarns to form the ground, and loops (14) knitted into the ground and each consisting of two legs (12, 13)) knitted into the ground and of two strands starting from the legs and of an apex connecting the two strands, the connection between the weft yarns (6) and the wales (8, 11) being such that each weft yarn (6) is first knitted into a first stitch of a first wale (11) in a weft connection, then into a second stitch (7) of a second wale (8) in a stitch connection, then into a third stitch (15) of a third wale in a second weft connection, then into a fourth stitch (9) of a fourth wale (8) in a stitch connection and then into a fifth stitch (10), which corresponds to the first stitch of a subsequent cycle, in a further weft connection, the second wale and fourth wale being disposed in the wale network between the first wale and the third wale and the two legs of a loop being knitted into the second and fourth stitches respectively.

9 Claims, 4 Drawing Sheets

LOW UNIT WEIGHT KNITTED LOOP FABRIC

This invention relates to a warp knitted fabric comprising loops. The loops are adapted to engage in hooks to form a self-closing fastening. The loop fabric comprises a ground consisting of warp yarns or a wale of stitches and connecting weft yarns or weft yarns which are connected to the warp yarns and a network of loops consisting of loop yarns knitted into the fabric ground. This kind of self-closing loop fabric is familiar in the prior art, notably for pilches for fastening and unfastening the top edges of the pilch.

This invention also relates to a layered system consisting of a support and of a knitted fabric as previously mentioned, the knitted fabric being stuck to the support. The support can be an intermediate support, the layered system then being secured to an article, such as a pilch, or it can be the actual article.

A problem always arising in the production of these self-fastening fabrics is that it is required to use the least possible quantity of weft yarns and warp yarns to make the ground yet to have a structure strong enough to retain the loops satisfactorily on the ground, particularly in a self-supporting position if possible—i.e., well clear of the fabric—to enable the male fastening elements to engage the loops satisfactorily. However, the fewer yarns which are used to make the ground, which is desirable economically, the more difficult it becomes to have loops knitted into the ground which are satisfactorily self-supporting so as to be clear of the ground, something which is desirable to help to obtain a self-fastening fabric of satisfactory quality—i.e., loops which are clear of the ground and which can be engaged readily by the male elements, for example, hooks.

This invention solves this dilemma by proposing a knitted loop fabric requiring fewer yarns from the weight point of view, particularly finer yarns, to make the fabric ground while maintaining the loops knitted into the ground as clear as possible thereof as when thicker yarns are used.

According to the invention, the knitted loop fabric comprising:

a ground of warp yarns or wales of stitches forming a network of wales parallel to one another and of weft connecting yarns or weft yarns, the latter being connected to the warp yarns to form the ground, and loops knitted into the ground and each consisting of two legs knitted into the ground and of two strands starting from the legs and of an apex connecting the two strands, is characterised in that:

the connection between the weft yarns and the wales is such that each weft yarn is first knitted into a first stitch of a first wale in a weft connection, then into a second stitch of a second w ale in a stitch connection, then into a third stitch of a third wale in a second weft connection, then into a fourth stitch of a fourth wale in a stitch connection and then into a fifth stitch, which corresponds to the first stitch of a subsequent cycle, in a further weft connection, the second wale and fourth wale being disposed in the wale network between the first wale and the third wale and the two legs of a loop being knitted into the second and fourth stitches respectively.

Because of this configuration of the weft yarns loops are obtained which are well clear of the ground, although the ground is made with yarns which are much smaller in diameter, and therefore lighter, than in the case of the prior art grounds. The reason for this is that the two legs of each loop are knitted into the respective second and fourth stitches, each experiencing two pulls in opposite directions of the weft yarn stitched into the stitch, the two pulls being directed away from the stitch so that by their respective opposing stretchings they tend to maintain the loop well clear of the ground.

According to an improvement of the invention, each wale consists of a cycle or pattern repeat of four stitches consisting alternately of two stitches which are landed on the needle knitting them alternately in a given direction (right to left or left to right) and of two stitches which are landed on the needle knitting them the other way round (left to right or right to left).

The fact that the wales consist of a cycle of four stitches, two of which are stitched in one direction and two in the other, ensures that two adjacent loops always tend to lie or incline in two opposite directions to one another according to the direction in which the wales extend, so that engagement of these loops with the male elements, for example, hooks, is as good as is provided by hooks coming from either side of the fabric, thus ensuring that in the case, for example, of pilches, the engagement of those male parts of the self-closing fastening which are disposed on the upper strip of the left layer is as good as that of the male parts of the self-fastening closure which are disposed on the upper right strip.

Preferably, the second stitch and the fourth stitch are disposed in the same wale—i.e., the second wale and the fourth wale are a single wale—and are separated from one another by a stitch corresponding to a first stitch or a third stitch of a weft yarn cycle.

This results in a fabric having very symmetrical loops.

According to an improvement provided by the invention, each loop consists of a first leg knitted into a said second stitch in one direction of landing on the bar, of an unravelling apex where the loop is unravelled, the unravelling being performed at a needle position between said two third consecutive stitches half-way between two wales and of a second leg knitted into a said fourth stitch in a landing direction opposite to the said one direction of landing, so that the next loop is made with its unravelling apex on the other side of the merged wale comprising the said second stitch and said fourth stitch into which the two legs of the previous loop are knitted.

This ensures that the final stability of the fabric is excellent.

The invention also relates to a layered system comprising a support to which a fabric of the kind hereinbefore described is stuck. More particularly this invention relates to a layered system of which the support is a diaper.

A description will now be given of a preferred embodiment of the invention solely by way of example and with reference to the accompanying drawings wherein.

Figure 1:
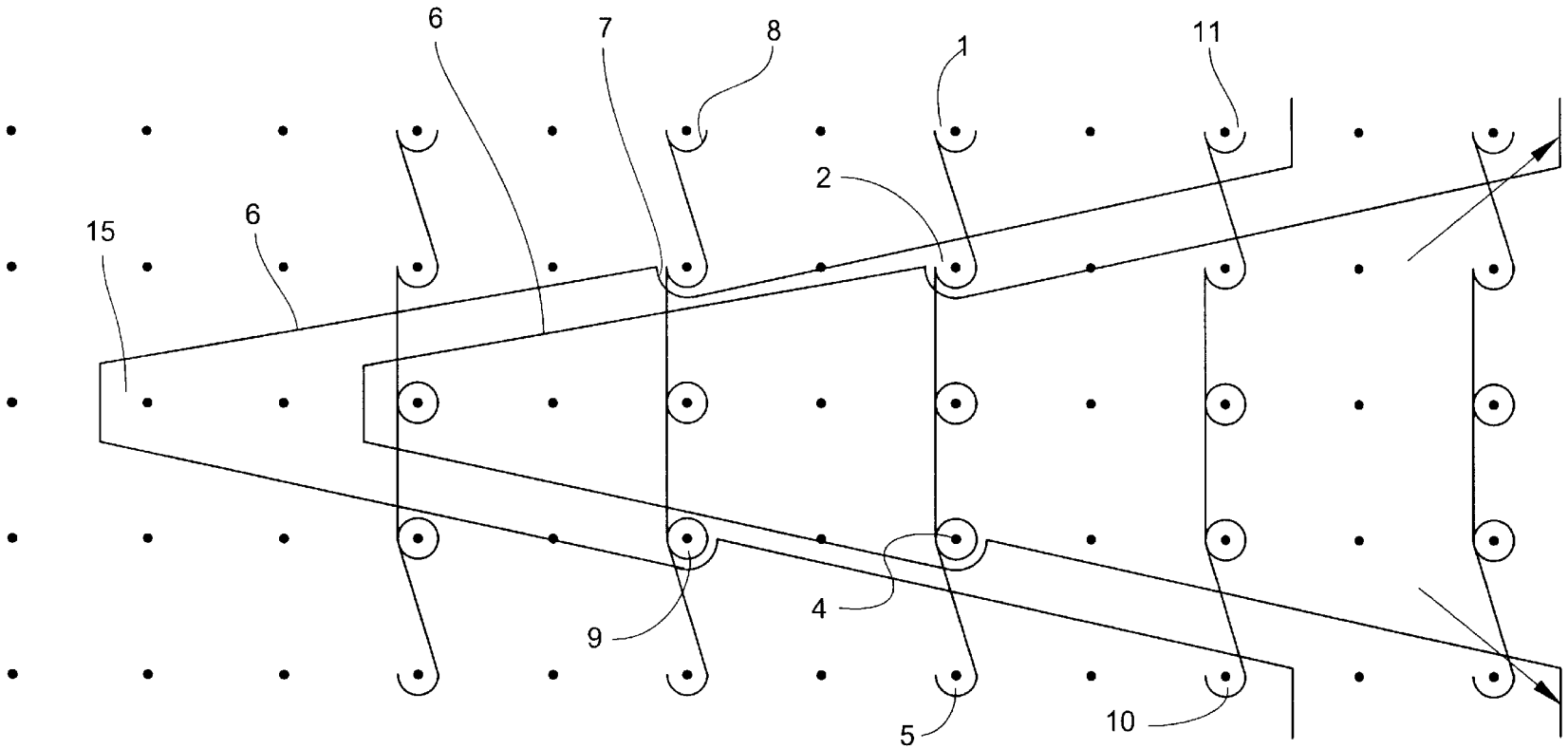
FIG. 1 is a plan view of a ground of the fabric in which a number of wales and two weft yarns each in a cycle are shown, the dots representing the landing positions of the needles.

FIG. 1 shows five wales which are vertical in FIG. 1 and which are arranged equidistant from one another. Each wale is formed as follows: a first stitch 1 made with a left-to-right warp landing, then a second stitch 2 also made with a left-to-right warp landing, then a third stitch 3 made with an opposite right-to-left warp landing and a fourth stitch 4 made with another right-to-left warp landing. A cycle of four stitches has therefore been shown. The remainder of the wale is produced using this four-stitch cycle, the stitch 5 being, for example, the fourth stitch of the previous cycle. Another possibility would be to use instead of the twice-two four-stitch cycle four times four eight-stitch cycles or four times n cycles where n is a whole number, the important consideration being that there is always an even number of identical stitches which follow one another. Each weft yarn 6 is knitted on its wales as follows: the weft yarn 6 is first stitched in a left-to-right stitch into a stitch 7 of a first wale 8 and is then looped around the stitch 15 without being stitched into it like a conventional weft yarn and is then stitched into a stitch 9 of wale 8 in a landing opposite to the landing of the stitch 7, and is then tied into a stitch 10 of the next wale 11 in a conventional weft connection with a landing opposite to the landing of the stitch 15, whereafter the weft yarn repeats its cycle on other stitches of the wale network.

Figure 2:
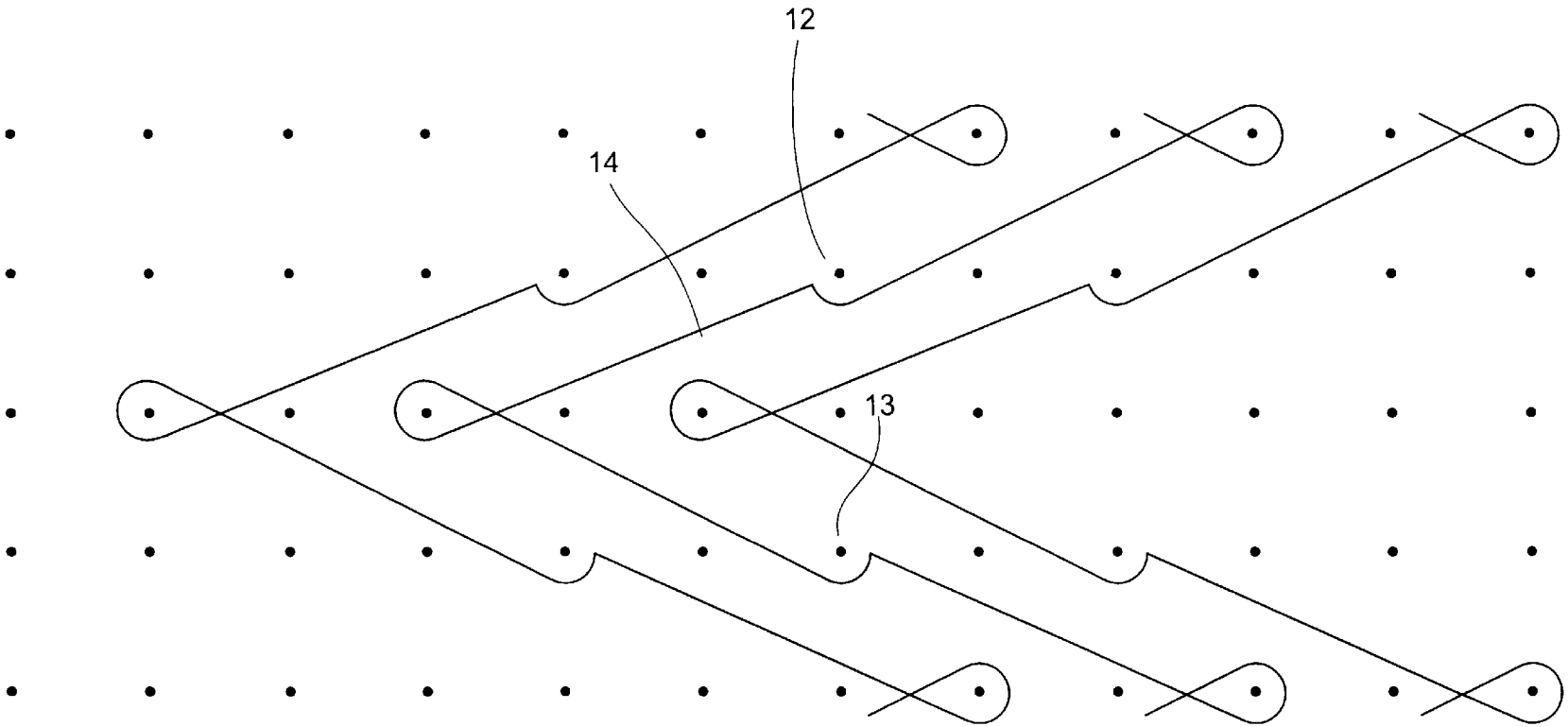
FIG. 2 is a plan view of the network of loops, the dots again representing the landing positions of the needles.

FIG. 2 shows the loop network. The loop yarns are first stitched in a left-to-right landing, then unravelled in unravelling wales (the wales of needles which are disposed between each wale) before being stitched again in the same wale in which the loops were previously stitched but at a distance from the previous stitch—i.e., every other stitch is stitched by a loop, the stitching of the loop occurring here from right to left, whereafter the loop yarn is unravelled in an unravelling wale symmetrically opposite the previous unravelling wale relatively to the wale in which the legs of the loop are disposed, then returns to the same wale to be stitched again into a stitch from left to right, and so on. The result is a network of loops which are oriented alternately to the left and the right of FIG. 2. The legs 12, 13 of the loop 14 correspond to two stitches of opposite bar landings in the wale, since each wale consists alternately of two stitches with a landing in on e direction and two stitches with a landing in the other.

Figure 3:
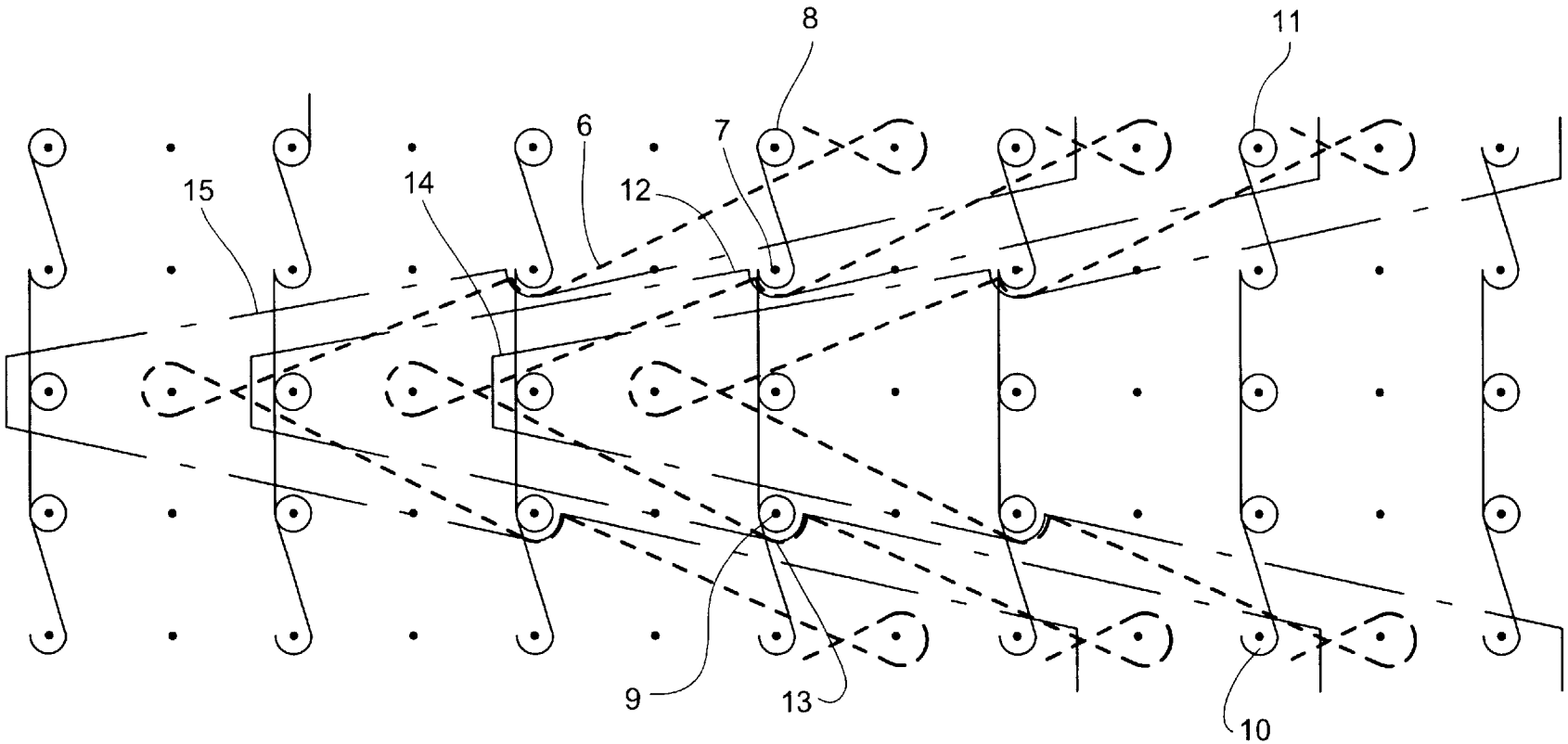
FIG. 3 is a plan view of a fabric showing the wales, weft yarns and loop yarns, the dots again corresponding to the landing positions of the needles.

FIG. 3 shows the ground with the network of knitted loops, the loops being shown in bold dash-dot line, the weft yarns being shown in normal broken line and the wales in bold continuous line. As FIG. 3 shows, in any given wale every other stitch corresponds to a loop leg and the intermediate stitches (also on the basis of every other stitch) correspond to a stitch around which a weft yarn is looped in an unstitched weft connection.

Also, the stitching directions of the two legs of any loop are opposite so that the resulting loops extend alternately to the left and to the right of the drawing. This alternation is not obligatory and it is possible to have loops of which all the legs are stitched in the same direction, giving a loop network in which all the loops extend in the same direction (to the left or to the right in the drawing). However, this alternation is well suited to the cycle of 2 stitches from left to right and 2 stitches from right to left of the wales to give a fabric which is well balanced and therefore very resistant to pulling stresses.

The warp and weft yarns which form the ground have a yarn thickness between 1 and 60 decitex, preferably of from 12 to 45, for example, 12 in the case of the warp yarns and 22 in the case of the weft yarns.

The loops have a yarn thickness of from 30 to 60 decitex, for example, 44 decitex.

Figure 4:
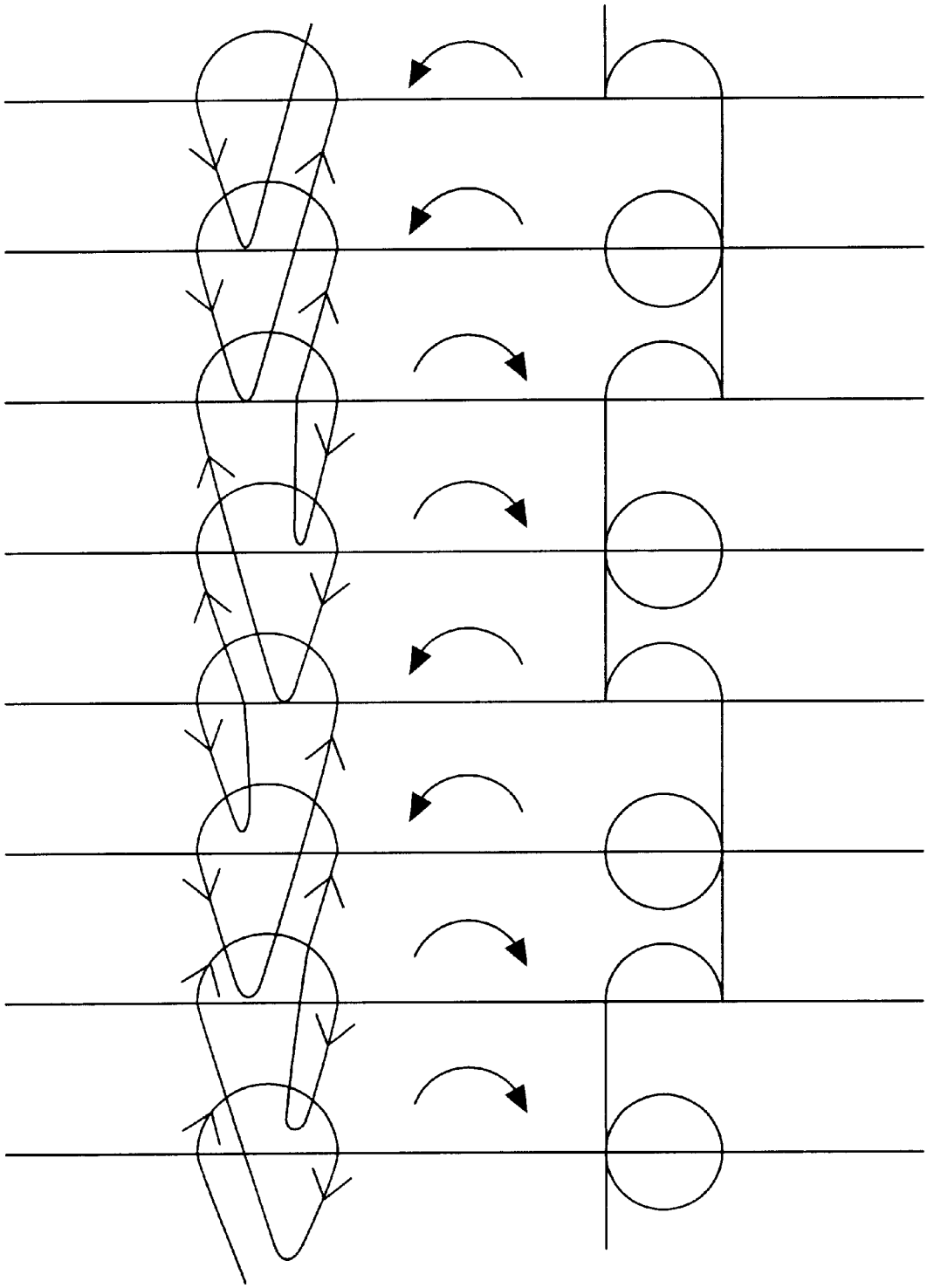
FIG. 4 shows a wale according to the invention.

FIG. 4 shows a wale four-stitch cycle, the first two stitches being formed from left to right (see arrows) and the next two stitches (starting from the bottom of FIG. 4) being formed from right to left (see the arrows in FIG. 4) and so on.

The fabric according to the invention has a weight that is less than 40 gsm, in particular a weight comprised between 15 gsm and 40 gsm.

What is claimed is:

1. A knitted loop fabric comprising:

a ground comprising wales of stitches, forming a network of wales parallel to one another, and weft yarns, said weft yarns being connected to the wales to form said ground, and loops knitted into the ground, each of said loops comprising two feet knitted into the ground and two strands starting respectively from said two feet and an apex connecting said two strands, wherein the weft yarns and said wales are connected in at least a cycle and a subsequent cycle so that for the cycle, each of the weft yarns is first knitted into a first stitch of a first wale in a weft connection, then into a second stitch of a second wale in a stitch connection, then into a third stitch of a third wale in a weft connection, then into a fourth stitch of a fourth wale in a stitch connection and then into a first stitch of said subsequent cycle, in a weft connection, the second wale and fourth wale being disposed in the wale network between the first wale and the third wale and the two feet of one of the loops being knitted into the second and fourth stitches respectively.

2. A fabric according to claim 1, wherein each wale comprises a cycle of four stitches comprising alternately two stitches which are landed on a first needle knitting them alternately in a given direction, and two stitches which are landed on a second needle knitting them in a direction opposite to said given direction.

3. A fabric according to claim 1, wherein the second wale is merged with the fourth wale in a merged wale, and the second stitch and the fourth stitch are disposed in said merged wale, and are separated from one another by a stitch corresponding to one of said first stitch and said third stitch.

4. A fabric according to claim 3, wherein each loop comprises a first foot knitted into a said second stitch in one direction of landing, an unraveling apex where the loop is unraveled, the unraveling being performed at a needle position between two consecutive said third stitches halfway between the two wales of the said two third consecutive stitches, and a second foot knitted into a said fourth stitch in a landing direction opposite to said one direction of landing, so that the next loop is made with its unraveling apex on the other side of the merged wale comprising the second stitch and the fourth stitch into which the first and second feet of the previous loop are knitted.

5. A fabric according to claim 1, wherein each of the weft yarns and stitch yarns has a thickness of from 1 to 60 decitex.

6. A fabric according to claim 1, wherein each of the weft yarns and stitch yarns has a thickness between 12 and 45 decitex.

7. A fabric according to claim 1, where in the loop yarns have a thickness of from 30 to 60 decitex.

8. A layered system comprising a support to which a fabric is stuck, said fabric comprising:

a ground comprising wales of stitches forming a network of wales parallel to one another, and weft yarns, said waft yarns being connected to the wales to form said ground; and loops knitted into the ground, each of said loops comprising two feet knitted into the ground and two strands starting respectively from said two feet and an apex connecting said two strands, wherein said weft yarns and said wales are connected in at least a cycle and a subsequent cycle so that for the cycle each weft yarn is first knitted into a first stitch of a first wale in a weft connection, then into a second stitch of a second wale in a stitch connection, then into a third stitch of a third wale in a weft connection, then into a fourth stitch of a fourth wale in a stitch connection and then into a first stitch of the subsequent cycle, in a weft connection, the second wale and fourth wale being disposed in the wale network between the first wale and the third wale and said two feet of one of said loop being knitted into the second and fourth stitches respectively.

9. A layered system according to claim 8, wherein the support is a diaper.

* * * * *